United States Patent [19]

Neuer

[11] Patent Number: 4,892,580

[45] Date of Patent: Jan. 9, 1990

[54] LEAD-CONTAINING ADDITIVE FOR STEEL MELTS

[75] Inventor: Bernd Neuer, Schnaitsee, Fed. Rep. of Germany

[73] Assignee: SKW Trostberg Aktiengesellschaft, Trostberg, Fed. Rep. of Germany

[21] Appl. No.: 270,535

[22] Filed: Nov. 14, 1988

[30] Foreign Application Priority Data

Nov. 19, 1987 [DE] Fed. Rep. of Germany ..... 3739154

[51] Int. Cl.[4] ..... C21C 7/02

[52] U.S. Cl. ..... 75/53; 420/86

[58] Field of Search ..... 420/86; 75/53, 58

[56] References Cited

U.S. PATENT DOCUMENTS

| | | | |
|---|---|---|---|
| 2,259,342 | 10/1944 | Harder | 420/86 |
| 3,728,109 | 4/1973 | Okubo | 420/86 |
| 4,389,249 | 6/1983 | Holowaty | 420/86 |
| 4,486,227 | 12/1984 | Douchy | 75/53 |

*Primary Examiner*—Peter D. Rosenberg

*Attorney, Agent, or Firm*—Felfe & Lynch

[57] ABSTRACT

The present invention provides a lead-containing additive for steel melts, wherein it is in the form of a cored wire consisting of a metallic sheath and finely-divided filling material, the finely-divided filling material consisting of (a) metallic lead and/or lead alloy(s), as well as (b) a lime-containing material which splits off carbon dioxide at the temperature of the steel melt.

16 Claims, No Drawings

LEAD-CONTAINING ADDITIVE FOR STEEL MELTS

The present invention is concerned with a lead-containing additive in the form of (cored) wires for the treatment of steel melts.

As is known, lead is used as an additive in the treatment of steel in order to improve the cutting properties, contents of 0.05 to 0.5% of lead in the steel usually being adjusted. The lead addition prolongs the life of the tools, optimises the cutting formation because the cuttings break off shorter and improves the surface quality of the workpiece.

Because lead practically does not dissolve in iron, in practice considerable problems arise in uniformly distributing the lead in the steel melt. For this purpose, the lead must be uniformly distributed in the steel melt in the manner of a suspension in the form of small droplets and this fine distribution must be maintained also up to solidification. When the lead droplets are too large, they separate out because of their high specific weight and thus lead to an insufficient lead distribution.

In practice, it was previously usual to carry out the addition of the lead in the case of ingot casting with the help of pouring funnels. The turbulence in the pouring canals thereby provided for a uniform lead distribution. A disadvantage hereby is the great burden placed upon the personnel by the lead vapour during the whole of the casting time.

Therefore, attempts have already been made to add the lead in the form of granules to the steel melt during tapping.

The lead is hereby introduced with great metal loss which not only gives rise to a corresponding contamination of the environment but also to an insufficient distribution of the lead in the steel melt. Injection techniques, such as the cored wire technique, admittedly reduce the metal losses but the first experiments with lead-filled cored wires have shown that in the case of the winding in of these wires into the steel melts, an insufficient lead distribution in the steel was observed. Relatively high lead concentrations at the commencement of casting and too low lead contents at the end of casting were regularly analysed in the batches.

Therefore, it is an object of the present invention to provide a lead-containing additive for steel melts which does not display the mentioned disadvantages of the prior art but rather makes possible a uniform distribution and a good introduction of the lead into the steel, also makes possible at the same time a safer handling and substantially avoids emissions into the surroundings.

Thus, according to the present invention, there is provided a lead-containing additive for steel melts, wherein it is in the form of a cored wire consisting of a metallic sheath and finely divided filling material, the finely-divided filling material consisting of (a) metallic lead and/or lead alloys, as well as (b) a lime-containing material which splits off carbon dioxide at the temperature of the steel melt.

Surprisingly, we have found that with the help of this additive, a safer and precise as well as uniform introduction of the lead into the steel is possible.

The additive according to the present invention is present in the form of a cored wire, consisting of a metallic sheath and a finely divided filling material which is encompassed by the sheath. The sheath material should be so chosen that it dissolves in the steel melt relatively quickly with liberation of the treatment agent without this sheath material or residues thereof introducing undesired components into the steel melt. Non-alloyed steel coverings have proved to be most suitable. As a rule, the thickness of the sheath is from 0.1 to 1 mm. and preferably from 0.2 to 0.6 mm.

The diameter of the whole cored wire can also be varied within wide limits but a diameter range of from 5 to 20 mm. and preferably of from 9 to 13 mm. has proved to be especially advantageous.

The filling material of the wire consists of two finely-divided components, the first component consisting of metallic lead and/or lead-containing alloys. In the scope of the present invention, by leadcontaining alloys are to be understood those alloys which consist preponderantly of lead and also contain other alloy components which do not have a negative influence on the work material properties of the steel to be treated. The lead or the lead alloys should be present in a form which is as finely divided as possible in order to pass over into very small droplets in the case of the treatment. For this purpose, the particle size should advantageously be not greater than 1 mm and preferably less than 0.8 mm. The lead or the lead alloys are preferably used in the form of small granulates or spheroids. The amount of lead per unit length of cored wire depends upon the diameter of the cored wire and varies between 100 and 1000 g. per meter of cored wire.

As second important component, the filler material of the wire consists of lime-containing material which, at the temperature of the steel melt (about 1550 to 1650° C.), spontaneously splits off carbon dioxide and is also present in the finely-divided form, i.e. with a particle size of $<1$ mm.

As lime-containing material, there can be used, for example, limestone or non-calcined dolomite. Finely-divided limestone or dolomite is obtained as by-product in the large-scale production of quicklime or calcined dolomite and is thus directed to a very suitable use.

The use of diamide lime has provided to be especially advantageous: this is obtained in the large-scale production of dicyandiamide from calcium cyanamide and consists essentially of especially finely-divided calcium carbonate (particle size about 90% $<60\mu$). Precisely because of its fine state of division, it is especially suitable for the purpose according to the present invention.

Due to these lime-containing materials which split off carbon dioxide, in the case of exact dosing into the steel melt, a turbulence is produced which, in the neighbourhood of the cored wire, is so intensive that the finest lead droplets are emulsified in the steel. The ascending gas bubbles simultaneously place the melt in a circulatory flow which provides for a homogeneous distribution of this emulsion in all regions of the ladle.

Because neither the liberated carbon dioxide nor the oxides remaining behind dissolve in the molten steel, the required steel analysis is not influenced.

The amount of lime-containing material splitting off carbon dioxide which is used depends upon the size of the charge to be treated and varies from 3 to 30% by weight, referred to the weight of the lead or lead alloy(s) used.

The production of the cored wire according to the present invention is not problematical and takes place according to conventional processes and methods. the finely-divided filling material is intensively mixed and subsequently filled into the wires which are closed by folding down or HF welding and then wound upon on to coils.

The steel treatment with the additive according to the present invention is safe and can be carried out without problems. The addition of the wire takes place in the casting ladle before casting. Depending upon the desired lead analysis in the steel, there are used 0.1 to 10 kg. of wire per tonne of steel melt to be treated, a spooling in rate of 50 to 180 m./minute and preferably of 100 to 120 m./minute having proved to be useful.

In this way, it is achieved that the additive is introduced into the steel melt safely and in a controlled way and that the optimum turbulence for the uniform distribution of the finely-divided lead droplets is produced. This uniform droplet distribution is, in turn, the reason for the good recovery of the lead in the scope of the present invention which is up to 70%.

The following Examples are given for the purpose of illustrating the present invention:

EXAMPLE 1.

360 m. of a 9 mm. cored wire were spooled into a 78 tonne steel melt (similar to CK 22) at a spooling in rate of 120 m./minute, which corresponded to an amount of 144 kg. of metallic lead (particle size 0.6 mm.). The filling material consisted of 8.65 kg. diamide lime (6% by weight, referred to the weight of the lead) with a particle size of 96% <0.063 mm. The filling material was encompassed by an iron sheet (wall thickness 0.4 mm.). For the whole batch, there were analyzed lead values of 0.12 to 0.13%. Thus, the average output was 68%.

EXAMPLE 2.

To 110 tones of a steel melt of the quality 10 S Pb 20 were added 350 kg. of lead in the form of a cored wire, the wire, which had a diameter of 13 mm., containing 880 g. of lead/m. and 8% by weight of limestone (particle size <100 μm.), referred to the weight of the lead. The spooling in rate was 120 m./minute. The final samples of this batch showed lead values of 0.22 to 0.24%. Thus, the average lead output was about 66%.

We claim:

1. A lead containing additive (for steel melts,) which comprises a cored wire consisting of a metallic sheath and finely-divided filling material, the finely-divided filling material consisting of (a) metallic lead or a lead alloy, and (b) a lime-containing material which splits off carbon dioxide at the temperature of the steel melt.

2. Additive according to claim 1, wherein the metallic sheath consists of non-alloyed steel.

3. Additive according to claim 1, wherein the metallic sheath has a thickness of from 0.1 to 1 mm.

4. Additive according to claim 3, wherein the metallic sheath has a thickness of from 0.2 to 0.6 mm.

5. Additive according to claim 1, wherein the cored wire has a diameter of from 5 to 20 mm.

6. Additive according to claim 5, wherein the cored wire has a diameter of from 9 to 13 mm.

7. Additive according to claim 1, wherein the filling material has a particle size of not more than 1 mm.

8. Additive according to claim 1, wherein the cored wire contains 100 to 1000 g of lead per meter.

9. Additive according to claim 1, wherein the lime-containing material which splits off carbon dioxide is limestone or uncalcined dolomite.

10. Additive according to claim 1, wherein the lime-containing material which splits off carbon dioxide is diamide lime.

11. Additive according to claim 1, wherein the lime-containing material is present in an amount from 3 to 30% by weight, based on the weight of the lead and lead alloy.

12. Process for the treatment of steel melts with a lead-containing additive, which comprises introducing a filled cored wire of claim 1 into the melt.

13. Process according to claim 12, wherein 0.1 to 10 kg of cored wire are introduced per ton of steel melt.

14. Process according to claim 12, wherein the cored wire is spooled into the steel melt at a rate of 50 to 180 m/minute.

15. Process according to claim 14, wherein the cored wire is spooled into the steel melt at a rate of 100 to 120 m/minute.

16. Use of a cored wire according to any of claims 1 to 11 as a lead-containing additive for steel melts.

* * * * *